US009808075B1

(12) United States Patent
Brubaker

(10) Patent No.: US 9,808,075 B1
(45) Date of Patent: Nov. 7, 2017

(54) PORTABLE CARRIER FOR NON-RIGID CONTAINERS

(71) Applicant: Richard Fretwell Brubaker, Rochester, MN (US)

(72) Inventor: Richard Fretwell Brubaker, Rochester, MN (US)

( * ) Notice: Subject to any disclaimer, the term of this patent is extended or adjusted under 35 U.S.C. 154(b) by 0 days.

(21) Appl. No.: 15/330,388

(22) Filed: Sep. 13, 2016

(51) Int. Cl.
*A45F 5/00* (2006.01)
*A45F 5/10* (2006.01)

(52) U.S. Cl.
CPC ..... *A45F 5/102* (2013.01)

(58) Field of Classification Search
CPC .. A45F 5/102; A45F 5/1026; A45F 2005/104; B65B 67/12
USPC ..... 294/158, 170, 214; 248/99
See application file for complete search history.

(56) References Cited

U.S. PATENT DOCUMENTS 63,383 A * 4/1867 Hanks ..... B65B 67/12 248/100
359,241 A * 3/1887 Case ..... B65D 25/32 16/425
1,057,240 A * 3/1913 Hildreth ..... B65B 67/1227 217/36
1,129,799 A * 2/1915 Hall ..... B65B 67/12 2/252
1,265,996 A * 5/1918 Cerny ..... B65B 67/12 141/328
2,317,535 A * 4/1943 Kitchen ..... A45F 5/1026 294/169
2,778,555 A * 1/1957 Poryle ..... A45F 5/1026 294/137
3,161,391 A * 12/1964 Bahnsen ..... D06F 95/004 248/99
3,313,504 A * 4/1967 Stoltze ..... B65B 67/12 206/283
3,388,882 A * 6/1968 Burroughs ..... B65B 67/1244 248/101
3,627,242 A * 12/1971 Vandermast ..... B65B 67/1205 248/153
3,687,408 A * 8/1972 Lake ..... B65B 67/1205 248/174
3,826,455 A * 7/1974 O'Donnell ..... B65B 67/1227 248/150
4,157,801 A * 6/1979 Elmer ..... B65B 67/12 248/101
4,287,701 A * 9/1981 Washington ..... B65B 67/1238 141/390
4,437,634 A * 3/1984 Hambleton ..... B65B 67/1227 220/495.11
4,984,759 A * 1/1991 Perlant ..... B65B 67/1227 108/108

(Continued)

*Primary Examiner* — Gabriela Puig

(57) ABSTRACT

A simple, portable carrier for a non-rigid container such as a plastic bag or sack that permits container to remain open for filling with articles or materials while serving as a carrying handle, especially suitable for highway crew members cleaning debris over long stretches of roadway. Device is comprised of a rigid member such as a hollow rod (tube), snug-fitting end caps, and end cap retaining bands. A segment of the open end of container is entrapped at each end of rigid member and held in place by friction between end caps and each end of rigid member. The device is reusable and is small enough to be carried in a pocket or on a belt loop.

2 Claims, 3 Drawing Sheets

(56) References Cited

U.S. PATENT DOCUMENTS 5,060,998 A * 10/1991 Phillips ..... A45F 5/1046 294/146
5,180,126 A * 1/1993 Bennett ..... B65B 67/12 248/97
5,183,339 A * 2/1993 Williams ..... B65B 67/12 141/390
5,222,536 A * 6/1993 Hodgdon ..... B65B 67/1205 141/108
5,516,175 A * 5/1996 Christensen ..... A45F 5/1046 294/137
5,527,076 A * 6/1996 Randels ..... A45F 5/1026 294/171
5,645,306 A * 7/1997 Kosteniuk ..... A45F 5/1026 294/137
5,803,522 A * 9/1998 Lisbon ..... A45F 5/1046 294/149
5,865,494 A * 2/1999 Tipp ..... A45F 5/10 294/137
6,199,690 B1 * 3/2001 Shin ..... A63B 55/00 206/315.3
7,090,272 B2 * 8/2006 Novakovich ..... A45F 5/1046 294/137
7,097,223 B1 * 8/2006 Bradford ..... A45F 5/1026 294/137
7,302,735 B2 * 12/2007 Palmer ..... A45F 5/1026 16/411
8,020,910 B2 * 9/2011 Startzell ..... A45F 5/1026 16/430
9,038,248 B1 * 5/2015 Linn ..... A01K 23/005 24/298
2002/0021012 A1 * 2/2002 Roye ..... B65B 67/1205 294/214
2004/0140681 A1 * 7/2004 Wilson ..... A45F 5/1026 294/137
2017/0066557 A1 * 3/2017 Slovis ..... A45F 5/10

* cited by examiner

Fig 5
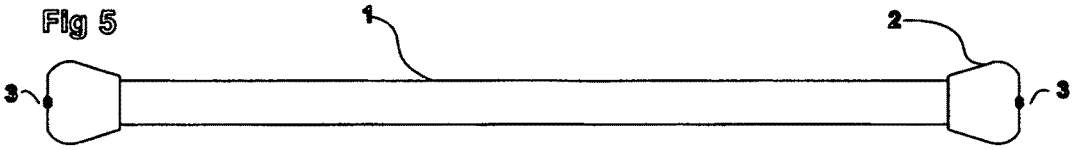
Fig 6
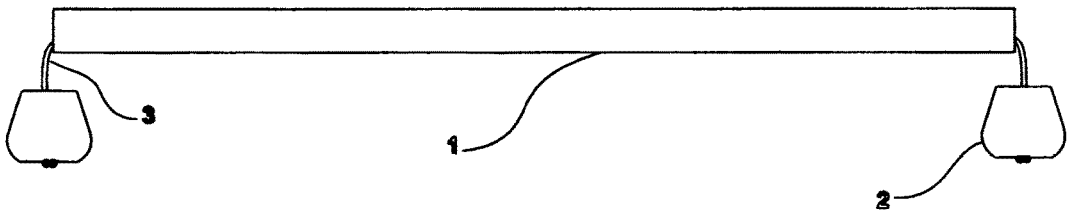
Fig 7
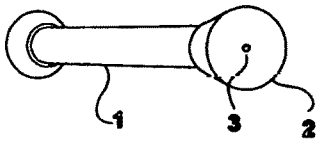
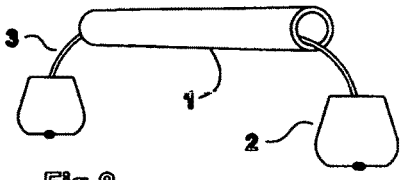
Fig 8

PORTABLE CARRIER FOR NON-RIGID CONTAINERS

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

Non-rigid containers such as bags, usually made of plastic, are cheap, disposable, and universally employed for the collection and disposal of refuse. An example is the use by highway crew members, often volunteers, who employ them to collect discarded highway refuse. Highway cleanup collectors may be required to carry these containers over long distances while picking up discarded items.

Users of non-rigid containers have two significant problems. First, it is awkward to keep them open, especially outdoors in windy conditions. Second, it is difficult to carry them when weighted down with contents, resulting in containers being dragged on the ground rather than carried. Highway trash collectors need a small, easily portable device that overcomes these two problems.

Many inventions have been described for opening and supporting non-rigid containers. However, no prior art is satisfactory as a carrier for roadway refuse collection. (See International Classification search number 665667/12, sack holders, i.e. stands or frames with means for supporting sacks in the open condition to facilitate filling with articles or materials.) Emphasis of prior art has been to support non-rigid containers in their fully open configuration with less emphasis on portability. As examples O. Hanks (U.S. Pat. No. 63,383), H. W. Hildreth (U.S. Pat. No. 1,057,240), E. B. Bannsen (U.S. Pat. No. 3,161,391), S. T. Stoltze U.S. Pat. No. 3,313,504), O'Donnell (U.S. Pat. No. 3,826,455), Elmer (U.S. Pat. No. 4,157,801), Lake (U.S. Pat. No. 3,687,408), Vandermast (U.S. Pat. No. 3,627,242), E. E. Burroughs et al. (U.S. Pat. No. 3,388,882), Hambleton (U.S. Pat. No. 4,437,634), describe framed stands that support and keep open a non-rigid container. These devices are useful at a fixed location or in a limited area but are awkward to carry over a long distance.

Washington (U.S. Pat. No. 4,287,701) describes a ring device for keeping a non-rigid container open, but this device lacks a handle.

F. W. Cerny (U.S. Pat. No. 1,265,996) and Linn (U.S. Pat. No. 9,038,248) describe, a handle for a non-rigid container that is suitable for small, light containers but is not suitable for carrying heavy ones.

Other handles have been described for carrying non-rigid containers having strings, straps, ropes, or other attachment points. None of these devices is suitable as a handle for a typical plastic trash bag devoid of attachment points. Examples are the devices described by Startzell (U.S. Pat. No. 8,020,910), Palmer (U.S. Pat. No. 7,302,735), Bradford (U.S. Pat. No. 7,097,223), Novakovich et al. (U.S. Pat. No. 7,090,272), Shin (U.S. Pat. No. 6,199,690), Tipp (U.S. Pat. No. 5,865,494), Lisbon (U.S. Pat. No. 5,803,522), Kosteniuk (U.S. Pat. No. 5,645,306), and Randels (U.S. Pat. No. 5,527,076).

This application introduces new art that can satisfy the utility, portability, and simplicity requirements of a carrier for non-rigid containers used by crews for highway refuse collection.

BRIEF SUMMARY OF THE INVENTION

A handle that attaches to a non-rigid container by means of friction is described. The device comprises three components: a rigid member having 2 ends such as a rod or tube, an end cap for each end of the rigid member, and a retaining band such as an elastic band for detachably securing each end cap from its associated end of the rigid member. To attach a container the end caps are first removed, the periphery of the open edge of a container is draped across the uncovered ends of the rigid member and the end caps are replaced over each end of the rigid member entrapping the open edge of the container. The edge of the container is held in place by the combined action of the friction of the entrapment and the action of the retaining band. The rigid member serves as a handle for carrying the container as well as a means for maintaining an opening for insertion of articles or material.

BRIEF DESCRIPTION OF THE SEVERAL VIEWS OF THE DRAWINGS

Drawing Sheet 1/3:

Drawing Sheet 2/3:

FIG. 5 is a front elevational view of a second embodiment of the invention with the end caps in place.

FIG. 6 is a front elevational view of a second embodiment of the invention shown in FIG. 5 with the end caps removed.

FIG. 7 is a side perspective view of a second embodiment of the invention shown in FIG. 5 with the end caps in place.

FIG. 8 is a side perspective view of a second embodiment of the invention shown in FIG. 5 with the end caps removed.

Drawing Sheet 3/3:

DETAILED DESCRIPTION OF THE INVENTION

Figure 1:
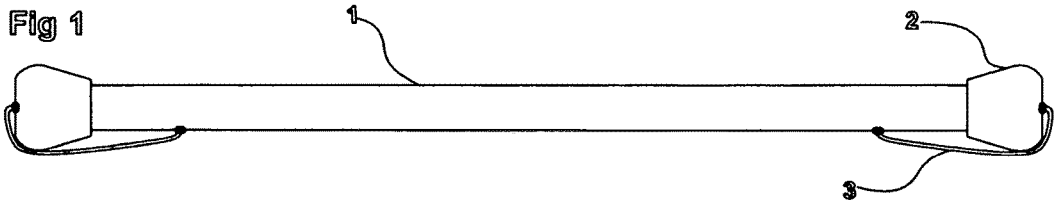
FIG. 1 is a front elevational view of one embodiment of the invention with the end caps in place.

Referring to the drawings wherein like numerals represent like elements throughout the several views, there is shown a portable non-rigid container carrier comprising three components: a rigid member (1) preferably a straight rod or tube having opposed ends, end caps (2) carefully fitted to the dimensions of the ends of rigid member (1) preferably composed of a rubber-like material, and a retaining bands (3) preferably composed of an elastic material.

Component 1. The preferred embodiment of the rod (1) is a hollow rod or tube composed of any suitable material such as metal (e.g. aluminum), plastic (e.g. polyvinyl chloride), or composite (e.g. carbon fiber). The strength of the rod (1) should be sufficient to resist bending under the maximum expected load. The optimum length of the rod (1) is dependent on the size of the opening of the container, such as a plastic bag (4), for which it is to serve as a handle. If the rod (1) is too short, the handle will not keep the container (4) open to a convenient width; if the rod (1) is too long, the tension along the opening is likely to tear the container (4). The optimum length is approximately ¼th of the circumference of the container's opening (7). A rod (1) intended for use with different sized containers must have a length that is adjustable. The cross-sectional area of the rod (1) preferably allows it to fit comfortably in the hand. The cross-sectional dimensions of the ends of the rod (1) are such as to allow an entrapment area (5) sufficient to prevent slippage of or perforation of the container (4).

Component 2. Caps (2) are used at each end of the rigid member (1) in order to entrap the container (4). If the caps (2) are to be fitted on the outside of the rigid member (1), they should have an inside diameter that is determined by the outside diameter of the corresponding end of rigid member (1) and the thickness of the material of the container (4). The inside diameter of the caps (2) should be small enough to hold the edge (6) of an entrapped container (4) by friction but not so small that it cannot be inserted over and removed from the end of the rod (1) by hand. The length of the overlap between the rod (1) and the cap (2) is important. If the length of the overlap is too short, the cap (2) is likely to be pulled off by a loaded container (4); if the length of the overlap is too long, the cap may be difficult to insert or the container (4) may tear along the length of the entrapment (5). The outside diameter and shape of the cap (2) should make it easy to grasp, pull, and twist by hand. The cap (2) can be made of any suitable material, but a flexible material, such as rubber, is preferable. The flexibility of a rubber cap (2) allows it to accommodate to various container thicknesses and is easy to grip by hand. The wall thickness of the overlapping portion of the cap (2) is determined by the physical properties of the cap material: the more flexible the material, the thicker the wall must be; the less flexible, the thinner the wall must be. The material must be strong enough not to tear under load yet flexible enough not to cause the container (4) to tear. If a hollow rod (tube) is chosen for the rigid member (1), end caps (2) can be configured to fit inside (rather than outside) the rod (1). Also, end caps (2) can be configured to fit both inside and outside the rod (1) to maximize the area of frictional contact between the container (4), the caps (2), and the rod (1).

Figure 2:
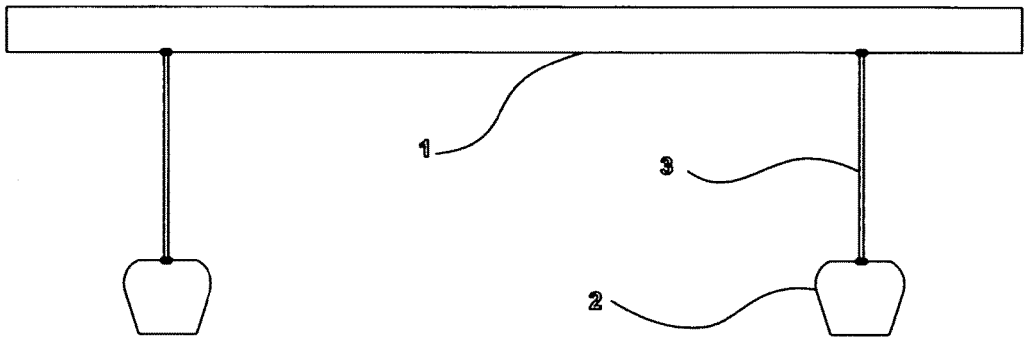
FIG. 2 is a front elevational view of the embodiment of the invention shown in FIG. 1 with the end caps removed.
Figure 3:
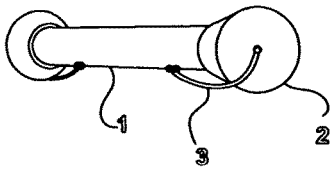
FIG. 3 is a side perspective view of the embodiment of the invention shown in FIG. 1 with the end caps in place.
Figure 4:
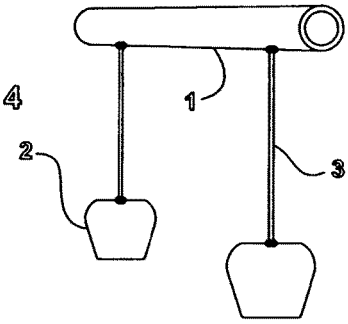
FIG. 4 is a side perspective view of the embodiment of the invention shown in FIG. 1 with the end caps removed.
Figure 9:
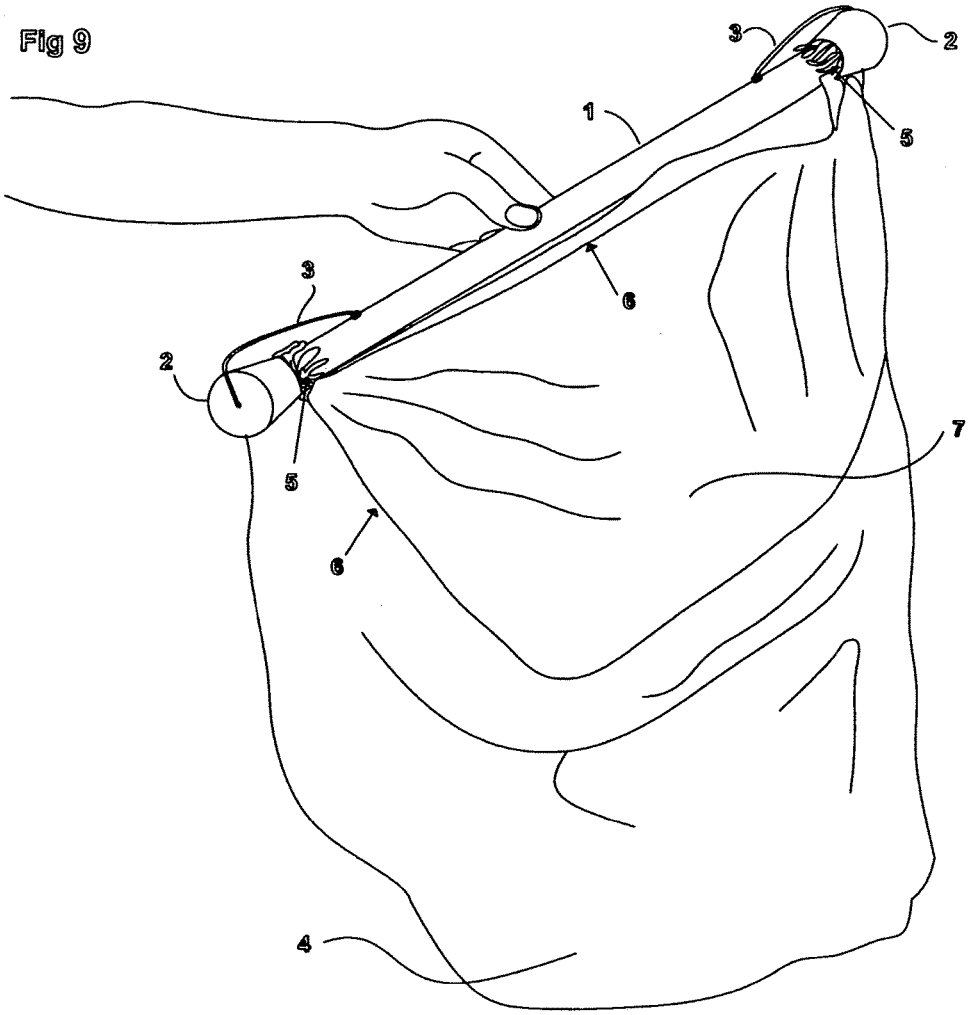
FIG. 9 is a sketch of an embodiment of the invention with an attached container (plastic bag) illustrating the carrier components, the entrapments of the margin of the container's opening, and the manner in which the container's opening is maintained and the container is carried.

Component 3. The third component of the carrier is means for detachably securing the caps (2) to the ends of the rod (1). In the embodiments shown in the drawings, the retaining means comprise an elastic band (3) attached at one end to each of the caps (2) and at the other end to the rod (1) (FIGS. 1-4) or a single elastic band (3) extending within the hollow rod (1) and attached at either end to one of the caps (2) (FIGS. 5-8). The retaining band (3) serves three purposes. First, it holds the caps (2) in place when the carrier is not in use preventing their loss. Second, it allows the caps (2) to be removed temporarily while the edge (6) of the container (4) is draped over the end of the rod (1). Third, the retaining band (3) helps keep the caps (2) in place while the carrier is in use. The retaining band (3) should be strong enough to hold the cap (2) in place but elastic enough to allow the cap (2) to be removed from the end of the rod (1) with minimal effort. The retaining band (3) should be attached to the cap (2) and the rod (1) in such a way not to interfere with the procedure of entrapment nor should its placement interfere with the use of the rod (1) as a handle. One method of attaching the retaining band (3) is to place it externally near each end of the rod (1) (FIGS. 1-4); another method is to place it in the cavity of a hollow rod (FIGS. 5-8).

Directions for use:

Step 1. Remove one end cap (2) from the rod (1).

Step 2. Drape a portion of the open edge of the container (6) over one end of the rod (1).

Step 3. Press the end cap (2) into place with a twisting motion, entrapping a portion (5) between the inside of the cap (2) and the outside of the rod (1).

Step 4. Remove the other end cap (2).

Step 5. Pull the edge of the container (6) along the length of the rod (1) and over its other end.

Step 6. Press the other end cap (2) into place with a twisting motion, entrapping another portion (5) the container's edge (6) at the other end of the rod (1).

The rod (1) is now the handle for carrying the container (4). The non-rigid container (4) will drape downward from either side of the rod (1) keeping the container (4) open (7) for insertion of articles or material. Once the container (4) is filled, both end caps (2) are removed with a twisting motion to release the container. Steps 1-6 can be repeated for additional containers.

I claim:

1. A portable carrier for non-rigid containers having an opening for depositing material into such container, comprising:

a. a rigid member having opposed ends;

b. a pair of end caps, one of which is associated with each of said ends of said rigid member, being sized to detachably, frictionally secure the periphery of the container to said rigid member; and c. a pair of elastic members attached at one end to said rod and at the opposite end to one of said caps.

2. A portable carrier for non-rigid containers having an opening for depositing material into such container, comprising:

a. a rigid hollow rod having opposed ends;

b. a pair of end caps, one of which is associated with each of said ends of said rigid member, being sized to detachably, frictionally secure the periphery of the container to said rigid member; and c. an elastic member extending through said hollow rod attached to each end to one of said end caps.

* * * * *